US011867202B2

(12) United States Patent
Eriksen et al.

(10) Patent No.: US 11,867,202 B2
(45) Date of Patent: Jan. 9, 2024

(54) PUMP WITH RING MOTOR

(71) Applicant: Marlin AS, Straume (NO)

(72) Inventors: Egil Eriksen, Ål (NO); John Dale, Kolltveit (NO)

(73) Assignee: Marlin AS, Straume (NO)

( * ) Notice: Subject to any disclaimer, the term of this patent is extended or adjusted under 35 U.S.C. 154(b) by 0 days.

(21) Appl. No.: 18/027,458

(22) PCT Filed: Oct. 15, 2020

(86) PCT No.: PCT/NO2020/050253

§ 371 (c)(1),
(2) Date: Mar. 21, 2023

(87) PCT Pub. No.: WO2022/081016

PCT Pub. Date: Apr. 21, 2022

(65) Prior Publication Data

US 2023/0366402 A1 Nov. 16, 2023

(51) Int. Cl.

| | |
|---|---|
| ***F04D 3/02*** | (2006.01) |
| ***F04D 13/10*** | (2006.01) |
| ***F04D 13/06*** | (2006.01) |

(52) U.S. Cl.

CPC ..... *F04D 3/02* (2013.01); *F04D 13/0646* (2013.01); *F04D 13/0653* (2013.01); *F04D 13/10* (2013.01)

(58) Field of Classification Search

CPC .... F04D 3/02; F04D 13/0646; F04D 13/0653; F04D 13/10; F04D 13/086; F04D 15/00

See application file for complete search history.

(56) References Cited

U.S. PATENT DOCUMENTS

| | | | | |
|---|---|---|---|---|
| 3,719,436 | A * | 3/1973 | McFarlin | H02K 7/14 417/356 |
| 5,818,131 | A | 6/1998 | Zhang et al. | |
| 8,074,592 | B2 * | 12/2011 | Schroder | B63G 8/08 440/6 |
| 2009/0293795 | A1 * | 12/2009 | Schroder | B63H 23/24 114/338 |

FOREIGN PATENT DOCUMENTS

| | | |
|---|---|---|
| CN | 104326073 | 2/2015 |
| CN | 107246395 | 10/2017 |
| CN | 107352007 | 11/2017 |

(Continued)

OTHER PUBLICATIONS

Norwegian Search Report for NO 20190564, dated Oct. 10, 2019.
International Search Report and the Written Opinion for PCT/NO2020/050253, dated May 7, 2021.

*Primary Examiner* — Eldon T Brockman
(74) *Attorney, Agent, or Firm* — Andrus Intellectual Property Law, LLP

(57) ABSTRACT

A pump in which an electric motor which is connected to a rotor provided with at least one pump vane is integrated into a pump casing. The electric motor is a ring motor surrounding at least a portion of a fluid flow path through the pump. A stator is arranged internally in an intermediate section of the pump casing and surrounds the rotor. The rotor, which is supported in the pump casing, is cylinder-shaped and forms an intermediate portion of the fluid flow path, and the at least one pump vane is attached internally in the rotor.

8 Claims, 3 Drawing Sheets

(56) References Cited

FOREIGN PATENT DOCUMENTS

| | | |
|---|---|---|
| CN | 109595179 | 4/2019 |
| DE | 10301877 | 7/2004 |
| EP | 0903835 | 3/1999 |
| ES | 2460616 | 5/2014 |
| GB | 2301399 | 12/1996 |

* cited by examiner

PUMP WITH RING MOTOR

CROSS-REFERENCE TO RELATED APPLICATIONS

This application is the U.S. national stage application of International Application PCT/NO2020/050253, filed Oct. 15, 2020, which international Applications was published on Apr. 21, 2022, as International Publication WO 2022/081016 in the English language. The international application is incorporated herein by reference, in entirety.

FIELD

The invention relates to a pump in which an electric motor coupled to a rotor provided with at least one pump vane is integrated into a pump casing.

BACKGROUND

In many systems there is a need to pump fluids of varying consistencies. Providing a pump of sufficient capacity and moderate dimensions is demanding, especially when the pump is to be placed downhole in a hydrocarbon well or in some other fluid line, where the volume available for the pump to be placed in is highly limited and where it is important to avoid undue restrictions of the flow area of the well or the line. In particular, there is a need to provide pumps that give minimal restrictions of the flow area in lines for the return transport of drilling mud between a subsea well and a surface installation in drilling without the use of a marine riser in extending a drill string, a return line for drilling mud, etc. In exploration drilling at great sea depths it is also an advantage if pumps that will have to be connected into the return line for drilling mud have moderate dimensions and for the overall weight of the return line to be limited as much as possible.

A pump in which a driving motor is arranged outside a pump casing often has a large cross section and a large volume, and many pumps like that exhibit the drawbacks that are described above.

SUMMARY

The invention has for its object to remedy or reduce at least one of the drawbacks of the prior art or at least provide a useful alternative to the prior art.

The object is achieved through the features that are specified in the description below and in the claims that follow.

The invention provides a pump provided with an impeller wheel arranged in a pump casing. The impeller wheel includes at least one pump vane which is attached internally in a sleeve which is axially and radially supported in the pump casing. The sleeve forms the rotor of an annular electric motor, for example like a permanent-magnet motor, in which several permanent magnets are arranged on the external wall surface of the sleeve. A stator surrounds the rotor, where armature windings being arranged on an internal wall surface of the pump casing.

To improve the reliability of the pump when it is used in the submerged state, for example in a hydrocarbon well, the ring motor is preferably oil-filled. To prevent oil leakage into the pump fluid path lying within, there may be dynamic seals arranged between end portions of the rotor and end portions of the pump casing. It is an advantage if an oil accumulator is in fluid communication with the oil-filled volume of the ring motor so that a prescribed oil pressure is maintained independently of the temperatures of the motor and the oil.

The pump casing is preferably sectioned, wherein the pump casing comprises a first end section which forms a first end portion of the pump casing and comprises a coupling portion for connection to a first fluid line, typically via a coupling flange or a threaded sleeve, and fasteners for releasably joining the first end section to a first end portion of a cylindrical intermediate section. A second end section forms a second end portion of the pump casing and comprises a coupling portion for connection to a second fluid line, typically via a coupling flange or a threaded, and fasteners for releasably joining the second end section to a second end portion of the cylindrical intermediate section. An electrical cable connecting the pump motor to an energy source is extended into the pump casing through a port which is preferably arranged in a fluid-sealing manner and typically arranged in the one of the end sections that faces a supply path for electrical energy. One of the end sections is preferably provided with a port for fluid communication between the oil-filled volume of the ring motor and an oil accumulator. A ring motor, preferably in the form of a frequency-controlled permanent-magnet motor, is arranged in an intermediate section with a stator attached to the intermediate section and a rotor supported in the intermediate section or the end section. The rotor is sleeve-shaped with a through centre path and is provided with several pump vanes arranged in the centre path.

The invention is defined by the independent claim. The dependent claims define advantageous embodiments of the invention.

The invention relates, more specifically, to a pump in which an electric motor which is connected to a rotor provided with at least one pump vane is integrated into a pump casing, wherein

- the electric motor being a ring motor surrounding at least a portion of a fluid flow path through the pump, in which
- a stator is arranged internally in an intermediate section of the pump casing and surrounds the rotor,
- the rotor, which is supported in the pump casing, is cylinder-shaped and forms an intermediate portion of said fluid flow path,
- the at least one pump vane is attached internally in the rotor, and
- dynamic seals are arranged at end portions of the rotor and define cavities in the pump casing and the electric motor in a fluid-sealing manner,
- said cavities being filled with a motor fluid in the form of oil and being in fluid communication with a motor-fluid-pressure regulator, and
- the motor-fluid-pressure regulator being connected to a control system which is arranged to monitor the composition of the motor fluid in the cavities of the ring motor, especially the occurrence of water in the motor fluid.

The electric motor may be a permanent-magnet motor, in which several permanent magnets are attached to an external wall surface of the rotor.

The electric motor may be a frequency-controlled permanent-magnet motor.

The motor-fluid-pressure regulator may be integrated into the pump casing.

The at least one pump vane may extend diametrically through the rotor.

Several pump vanes may project freely from the internal rotor-wall surface of the rotor towards a centre axis of the rotor.

The control system may be arranged to monitor the rotational speed of the rotor and vibration in the pump.

The motor-fluid-pressure regulator may be arranged to maintain a motor-fluid pressure in the cavities of the ring motor at a level which lies somewhat above the pressure of the fluid that is being pumped.

BRIEF DESCRIPTION OF THE DRAWINGS

In what follows, examples of preferred embodiments are described, which are visualized in the accompanying drawings, in which.

DETAILED DESCRIPTION OF THE DRAWINGS

Figure 1:
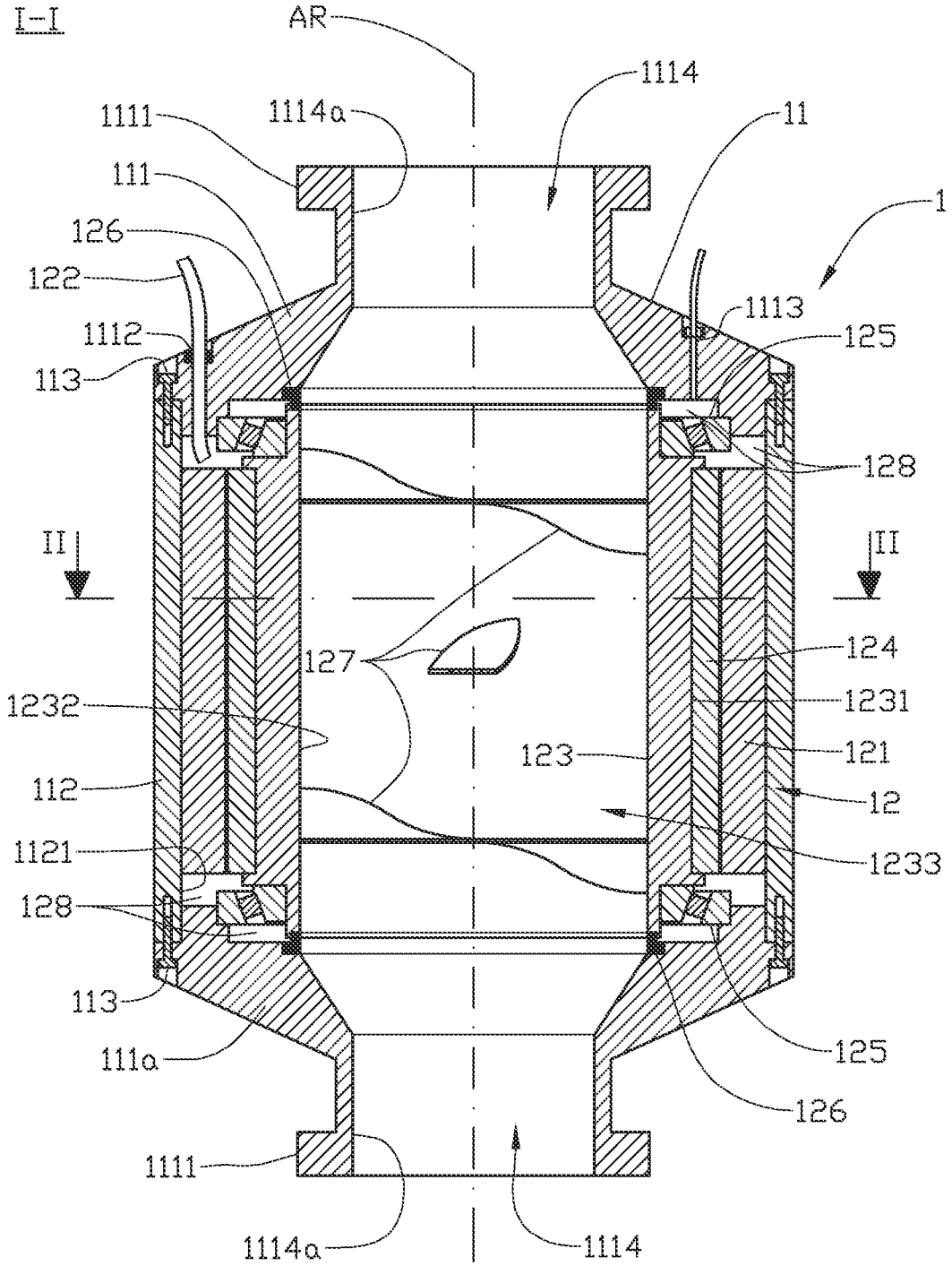
FIG. 1 shows an axial section I-I according to FIG. 2 through a pump with a first pump-vane design according to the invention.
Figure 2:
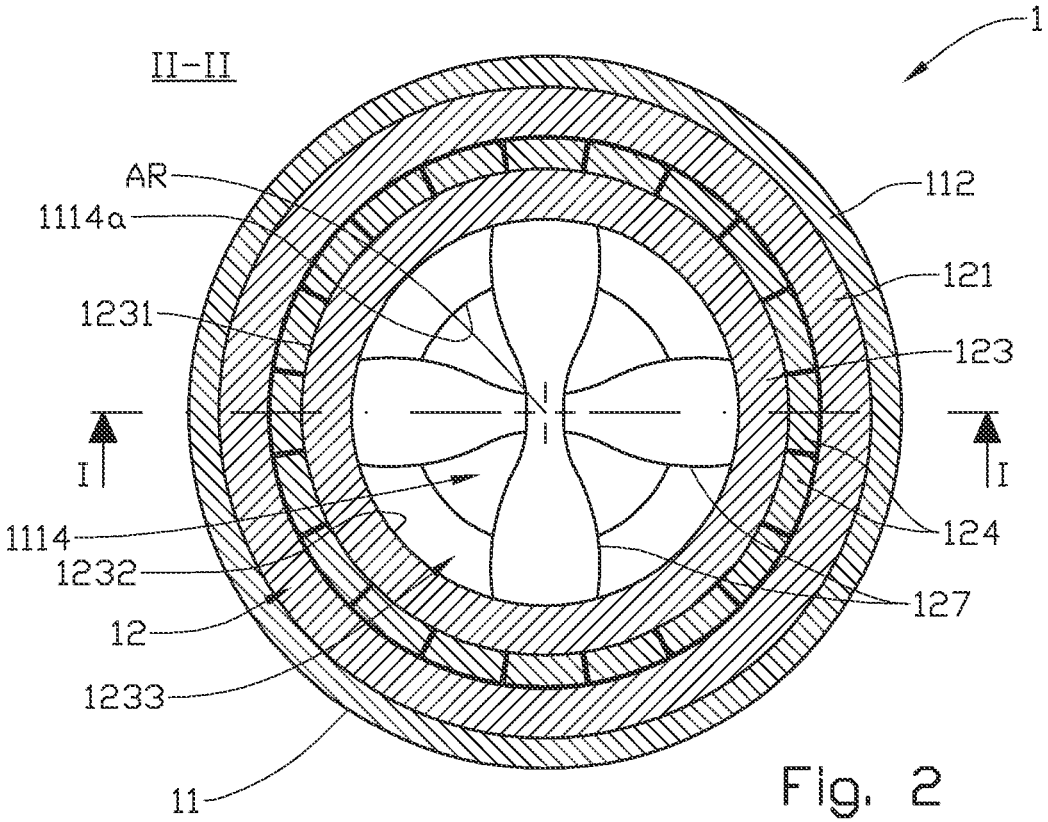
FIG. 2 shows a radial section II-II according to FIG. 1 through the pump.

In the drawings, the reference numeral 1 indicates a pump in which an electric ring motor 12 is integrated into a pump casing 11.

The pump casing 11 is formed of a cylindrical, tubular intermediate section 112 and first and second end sections 111, 111*a*. The end sections 111, 111*a* fit tightly against respective end portions of the intermediate section 112 and are held fixed by means of several fastening means 113, shown as screws here. Each end section 111, 111*a* forms a fluid port 1114*a* for the inlet and outlet, respectively, of a pump fluid which may flow in a fluid flow path 1114 extending through the pump 1. The end sections 111, 111*a* are arranged to be connected to fluid lines (not shown) carrying the pump fluid to the pump 1 and carrying the fluid away from the pump 1, respectively, for example by means of coupling flanges 1111 as shown in the drawings, or other forms of fluid-sealing coupling portions.

The pump casing 11 accommodates the electric ring motor 12, a stator 121 being secured to an internal wall surface 1121 of the intermediate section 112. A rotor 123 which is surrounded by the stator 121 is radially and axially supported in the pump casing 11 by means of rotor bearings 125. On an external rotor-wall surface 1231, several permanent magnets 124 are attached. On an internal rotor-wall surface 1232, several pump vanes 127 are attached, which, in this embodiment, extend diametrically through a centre path 1233 of the rotor 123.

The stator 121 is connected to a power source (not shown) suitable for the purpose via an electrical wire 122 which has been extended out of the ring motor 12 through a fluid-sealing cable gate 1112 in one of the end sections, shown here in a first end section 111 which is typically the one of the end sections 111, 111*a* that lies the nearest to the power source.

Figure 3:
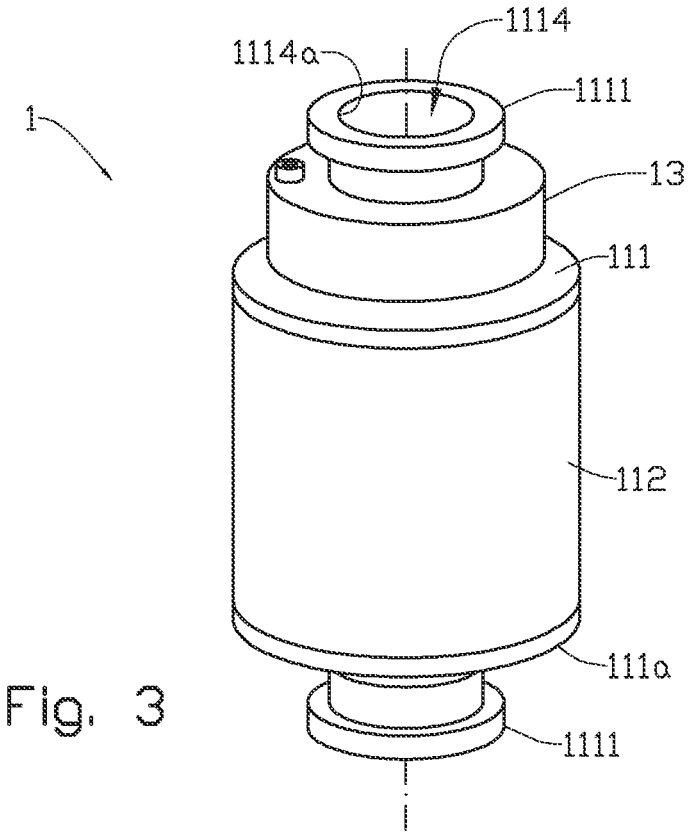
FIG. 3 shows, on a smaller scale, a perspective view of an embodiment of the pump with an integrated motor-oil accumulator.

The rotor 123 fits fluid-sealingly against the pump casing 11, typically by the end portions of the rotor 123 and opposite end portions of the end sections 111, 111*a* being provided with dynamic rotor seals 126, especially in the form of ceramic seals. Cavities 128 in the ring motor 12 may thereby be filled with motor fluid, typically an oil suitable therefor, which prevents any ingress of the pump fluid and prevents corrosion and short-circuiting. The cavities 128 are pressure-equalized as they, via one or more ports 1113 in one of the end sections 111, 111*a* of the pump casing 11, here shown in the first end section 111*a*, are in fluid communication with a motor-fluid-pressure regulator 13 (see FIG. 3). The pressure of the motor-fluid-pressure regulator 13 is preferably arranged to be adapted to the pump-fluid pressure in and around the pump 1. It is an advantage if the motor-fluid-pressure regulator 13 can maintain a motor-fluid pressure in the cavities 128 of the ring motor at a level which lies somewhat above the pressure of the pump fluid, that is to say the fluid that is being pumped. The motor-fluid-pressure regulator 13 is connected to a motor-fluid reservoir (not shown) which provides for replenishing the cavities 128 with motor fluid by leakage across the rotor seals 126 from the cavities 128 to the fluid flow path 1114. The motor-fluid-pressure regulator 13 may comprise pressure transmitters (not shown) arranged at the fluid ports 1114*a* of the end sections 111, 111*a* for registering the pump-fluid pressure upstream and downstream of the pump 1. The motor-fluid-pressure regulator 13 is connected to a control system (not shown) which may also monitor other conditions in the pump 1, such as the rotational speed of the rotor 123, vibration in the pump 1, the composition of the motor fluid in the cavities 128 of the ring motor 12, especially the occurrence of water in the motor fluid. The control system may be connected to several pumps 1 and is typically arranged on an installation remote from the pump 1, for example on a surface installation in the form of a floating drilling rig (not shown) connected to a hydrocarbon well.

In a manner known per se, the power supply (not shown) of the ring motor 12 is arranged to adjust the working speed of the ring motor 12, for example by frequency control, and the direction of rotation of the rotor 123.

By integrating the ring motor 12 into the pump casing 11 and letting the rotor 123 of the ring motor 12 form a flow path in which the pump vanes 127 are arranged, a pump 1 is provided that is very well suitable for being lowered into a space of a small cross section and where it is important to avoid flow-obstructing cross-sectional reductions, for example in a well pipe in which production fluids, drilling fluid or the like are to be able to flow at a great flow rate. A pump 1 of this kind is also well suited for integration into a fluid line, especially in a drilling-mud return line in drilling without the use of a marine riser for the drill string and fluid lines.

Figure 4:
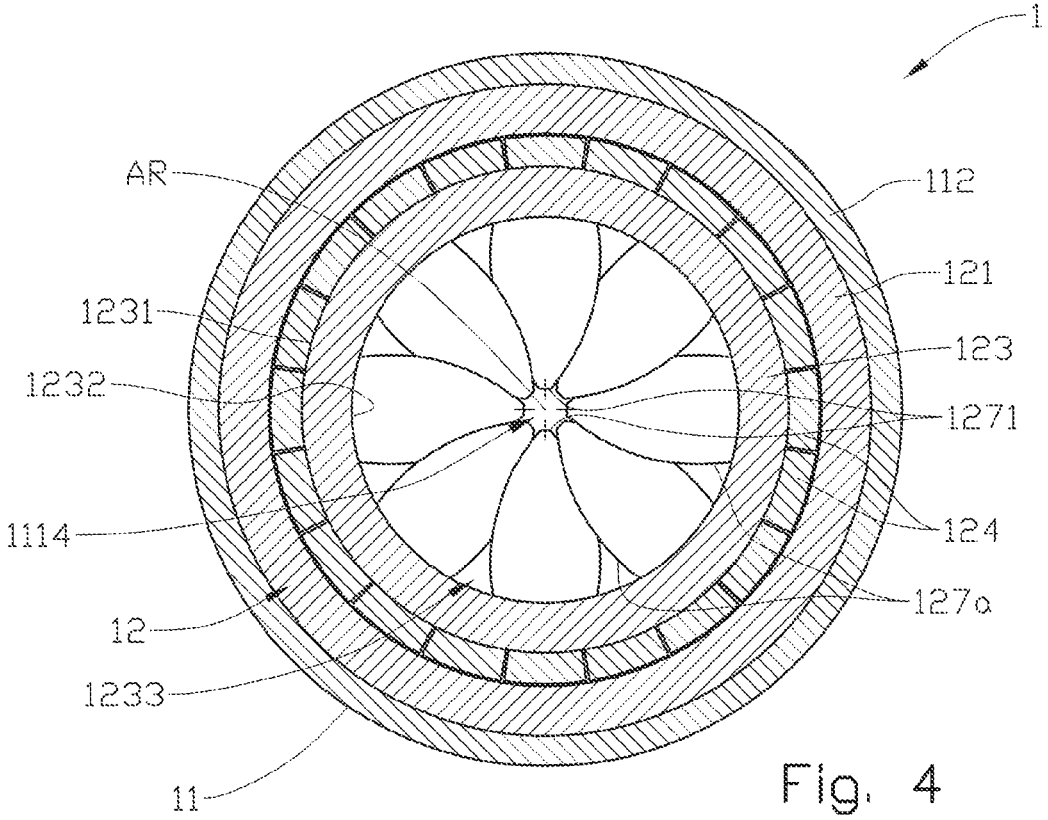
FIG. 4 shows, on the same scale as FIG. 2, a radial section through the pump with an alternative pump-vane design.

Reference is now made to FIG. 4, in which the pump 1 is provided with several pump vanes 127*a* projecting inwards from the internal rotor-wall surface 1232 towards a centre axis AR in the rotor 123, the vane end portions 1271 of opposite pump vanes 127*a* lying at a distance from each other.

It should be noted that all the above-mentioned embodiments illustrate the invention, but do not limit it, and persons skilled in the art may construct many alternative embodiments without departing from the scope of the attached claims. In the claims, reference numbers in brackets are not to be regarded as restrictive.

The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A pump in which an electric motor which is connected to a rotor provided with at least one pump vane is integrated into a pump casing, the electric motor being a ring motor surrounding at least a portion of a fluid flow path through the pump, a stator being arranged internally in an intermediate section of the pump casing and surrounding the rotor, the rotor, which is supported in the pump casing, being cylinder-shaped and forming an intermediate portion of said fluid flow path, the at least one pump vane being attached internally in the rotor, dynamic seals being arranged at end portions of the rotor and defining cavities in the pump casing and the electric motor in a fluid-sealing manner, said cavities being filled with a motor fluid in the form of oil and being in fluid communication with a motor-fluid-pressure regulator, wherein the motor-fluid-pressure regulator is connected to a control system which is arranged to monitor the composition of the motor fluid in the cavities of the ring motor, including the occurrence of water in the motor fluid.

2. The pump according to claim 1, wherein the electric motor is a permanent-magnet motor in which several magnets are attached to an external surface of the rotor.

3. The pump according to claim 2, wherein the electric motor is a frequency-controlled permanent-magnet motor.

4. The pump according to claim 1, wherein the motor-fluid-pressure regulator is integrated into the pump casing.

5. The pump according to claim 1, wherein the at least one pump vane (127) extends diametrically through the rotor.

6. The pump according to claim 1, wherein several pump vanes project freely from the internal rotor-wall surface of the rotor towards a center axis (AR) of the rotor.

7. The pump according to claim 1, wherein the control system is arranged to monitor the rotational speed of the rotor and vibration in the pump.

8. The pump according to claim 1, wherein the motor-fluid-pressure regulator is arranged to maintain the motor-fluid-pressure in the cavities of the ring motor at a level which lies somewhat above the pressure of the fluid which is being pumped.

* * * * *